United States Patent [19]

Mosse et al.

[11] 4,402,461

[45] Sep. 6, 1983

[54] FLUID-HANDLING APPARATUS

[75] Inventors: Richard W. E. Mosse, London; Kaare B. Vatne, Ware, both of England

[73] Assignee: Liquipak International Inc., St. Paul, Minn.

[21] Appl. No.: 279,343

[22] Filed: Jul. 1, 1981

[51] Int. Cl.[3] ..... B05B 1/32; B67D 5/40

[52] U.S. Cl. ..... 239/453; 222/381

[58] Field of Search ..... 239/453; 222/381 X, 222/383, 380

[56] References Cited

U.S. PATENT DOCUMENTS

| | | | |
|---|---|---|---|
| 2,962,227 | 11/1960 | Whitehurst | 239/453 |
| 3,022,954 | 2/1962 | Davies et al. | 239/453 |
| 4,220,264 | 9/1980 | Gamadia | 222/383 |

*Primary Examiner*—Jeffrey V. Nase
*Assistant Examiner*—Mary McCarthy
*Attorney, Agent, or Firm*—Wood, Dalton, Phillips, Mason & Rowe

[57] ABSTRACT

A filling device for cartons comprises a row of vertical ducts arranged along a path of the cartons. Each duct includes, progressing downwardly, an upper bellows, a ducting section incorporating an inlet valve, a lower bellows, and a fixed nozzle incorporating an outlet valve. The section is vertically reciprocated by a ram. The nozzle comprises a tubular housing containing a valve member comprising a closure part co-operating with a valve seat at the lower extremity of the housing, a stem, and a driving part of inverted cup shape fixedly received with clearance on the stem and movably received with clearance in the housing.

5 Claims, 2 Drawing Figures

FLUID-HANDLING APPARATUS

BACKGROUND OF THE INVENTION

1. Field of the Invention

This invention relates to fluid-handling apparatus, in particular for filling a carton.

2. Description of the Prior Art

European Patent Publication No. 0013132 discloses an aseptic packaging machine which includes a chain conveyor conveying cartons along a path in an aseptic chamber including an advance leg and a return leg each extending along the machine. Ultra-violet germicidal lamps extend over at least a major portion of the advance leg. Aseptic liquid is fed into the cartons by a filling device. After filling, the cartons are top-heated and sealed by a top-heating device and a top-sealing device. The only non-aseptic matter deliberately introduced into the chamber is the cartons. The chamber is cleaned internally by cleaning fluid from spray nozzles. The carton entry to and exit from the chamber have aseptic air curtains.

The filling device is particularly designed to prevent microbes obtaining access to the aseptic liquid product being supplied to the aseptic chamber. The filling device includes a mounting frame which mounts four stainless steel reciprocatory bellows having bottom walls which are reciprocatorally driven by respective reciprocatory plungers and having top flanges fixed to respective lower limbs of fixed T-unions. Respective upper limbs of the unions contain respective spring-loaded, non-return, inlet valves which open to allow downward flow through the limbs. Intermediate limbs of the respective unions are connected to respective arcuate pipes which curve downwardly towards the path of the cartons and which at their lower ends are connected to respective outlet nozzles which contain respective spring-loaded, non-return, outlet valves. The chains advance the cartons stepwise directly below the line of nozzles and a selected number of the bellows are operated each to deliver a predetermined dosage of long-life milk to the vertically upright cartons, the number of bellows operated being dependent upon the nominal capacity of the cartons. Thus, with each bellows being pre-set to deliver a half pint at each reciprocation, all four bellows are operated for cartons which can each hold one quart. On each bellows performing a pressure stroke, because the inlet valve in its union is held closed by its spring and by the milk pressure, the inlet valve is automatically opened against the action of its spring so that the bellows can draw in milk from an expansion chamber.

In a widely used design applicable to that machine, the nozzle would comprise a tubular housing and a valve member in the housing. The tubular housing is formed internally, at a location spaced an appreciable distance above its lower extremity, with a valve seat in the form of a downwardly-facing, frusto-conical surface. Immediately beyond this surface, the housing widens to form an expansion space and then narrows again to continue downwards as a cylindrical bore. The valve member comprises a disc-form driving part, a stem extending downwards from the driving part, and a closure part fixed to the lower end of the stem and having a frusto-conical surface co-axial with the housing and arranged to come face-to-face with the valve seat. This latter surface is formed with a co-axial annular groove containing an elastomeric O-ring for sealing against the valve seat. The valve member is movable axially between a closed condition in which the closure part is within the tubular housing and acts sealingly on the valve seat by way of the O-ring and an open condition in which the closure part is still within the housing but spaced downwards from the valve seat. The valve member is encircled by a closing spring urging the closure part into its closed position. The valve member is opened by the pressure differential between the pressure of the liquid upstream of the driving part and the pressure downstream of the driving part. When this pressure differential is sufficiently high to overcome the pressure of the spring, the valve member opens. The driving part is considerably smaller in diameter than is the O-ring. The extent of compression of the spring determines the extent of opening of the valve member. The valve member includes a second stem extending downwardly from the closure part and widening at its lower end region to obturate the cylindrical bore in the closed condition of the valve member. In the open condition, the lower extremity of this stem is spaced downwards from the housing and the liquid can flow down therebetween. The valve member also includes two or more fins which extend upwardly from the lower end of the second stem and slide on the surface of the cylindrical bore. Were it not for the fins, in the open condition of the valve member, the liquid would flow from the valve member as a substantially unbroken tube of liquid. This would mean that air trapped within the tube of liquid and increasingly under pressure as the liquid level in the carton climbs would be forced to break through the tube of liquid to escape and in so doing would disturb the smooth flow of the liquid into the carton and cause splashing of liquid beyond the carton. The presence of the fins ensures that corresponding vents are formed along the tube of liquid through which vents air can flow without disturbing the flow of the liquid.

The machine described above has a number of disadvantages in connection with its filling device.

There is an optimum range of rate of flow of liquid into the carton, but the flow rate is dependent upon the pressure under which the liquid is being urged past the closure part, which is approximately the same as the opening pressure of the valve member. However, the opening pressure is dependent upon the effective area of the valve member acted upon by the liquid pressure. Therefore a relatively small effective area requires a relatively high opening pressure which involves an undesirably high rate of flow of liquid into the carton and in practice a high degree of turbulence. A further disadvantage is that the small effective area over which the liquid pressure acts to open the valve member may produce an opening force which is insufficient to prevent hunting of the valve member, which results in an unsteady flow of liquid into the carton, but a steady, smooth flow is desirable. The use of an O-ring mounted in a groove provides, between the ring and the wall of the groove, very narrow crevices in which foreign matter, including microbes, can gather, but which are almost inaccessible to cleaning fluid. In addition, the housing has an appreciable area of its internal surface below the annulus of sealing between the valve seat and the O-ring, and this area is normally wetted by contact with the liquid from the open outlet valve, so that there is a risk that liquid will drip from the nozzle even when the outlet valve has been fully closed and thus drip onto the exteriors of cartons or onto the conveyor forwarding the cartons. Such dripping is obviously undesirable. Furthermore, unsteadiness of flow can also occur because the maximum extent of opening of the closure part is variable. Stainless steel has a limited fatigue life on being flexed and is therefore liable to fracture. Fracturing of the bellows allows penetration of bacteria and/or leakage of liquid. Moreover, stainless steel is a relatively expensive material and is relatively expensive to fabricate into a bellows. Finally, the arrangement whereby the liquid passes via a union into a pumping bellows and then partly back through the union towards a nozzle is difficult to clean and to purge of cleaning fluid.

A variable area valve disclosed in U.S. Pat. No. 3,022,954 includes a valve stem formed with flutes which are either arranged in axial planes or arranged helically around the stem. In both cases, they terminate at such a distance upstream of the annulus of sealing between the valve closure member and the valve seat that the streams of liquid among the flutes reunite upstream of the downstream extremity of the valve closure member, so that the liquid flows from the valve member as a substantially unbroken tube of liquid.

British Pat. No. 1335007 discloses a metering device for liquids and pastes, comprising at least one unit having an inlet valve and an outlet valve which is connected by a bellows of polytetrafluoroethylene, for example, to the inlet valve and which has a valve body in the form of a diaphragm carrying an outlet nozzle, the two ends of the bellows of each such unit being clamped to two spaced horizontal plates which are relatively movable through an adjustable distance, there being some means to open the inlet valve when the plates are moving apart and to close the inlet valve when the plates are moving together, the outlet valve being arranged to open when the plates are moving together and to close when the plates are moving apart. The inlet valve can consist of a stem extending through the wall of ducting leading to the bellows and provided at its end within the ducting with a frusto-conical valve plate which cooperates with a similarly shaped valve seat formed by an internal shoulder of the ducting. The diaphragm of the outlet valve can be arranged to be held in a closed position by compressed air introduced around the nozzle and beneath the diaphragm. However, the diaphragm of the outlet valve may instead be prestressed so that it is bent upwardly and not downwardly when it is relaxed. In this instance, it is possible to dispense with the compressed air control, since the outlet valve is always in the closed position except when the lower plate is being moved upwardly. However, in the latter circumstance, i.e. when the bellows is being compressed, the pressure of the liquid in the bellows overcomes the prestress of the diaphragm, so that the outlet valve opens and allows the liquid to escape. However, such an arrangement has the disadvantage of lesser operational reliabiity than that utilizing compressed air control. The inlet valve, which is angled, may be replaced by a vertical-axis valve which, if required, may also be provided with a pneumatic control arrangement.

The metering device just described has the disadvantage that polytetrafluoroethylene is a relatively expensive material and very expensive to fabricate into a bellows shape. The device also has the disadvantage that either the nozzle and its supporting plate have to be reciprocated vertically with the nozzle being moved in and out of the carton, which involves a relatively slow cycle of lowering and lifting, or the upper plate, with at least a significant section of the ducting, has to be lifted and lowered, which again involves not only a relatively slow cycle of movement, but also a relatively complicated mounting arrangement.

U.S. Pat. No. 2,962,227 discloses a fuel injection nozzle comprising a tubular body internally screwthreaded to receive a connector nipple having an internal bore terminating at its lower end in a cylindrical chamber. Located in the chamber is a detachable tubular valve housing through which extends a stem carrying at its lower end a valve closure member of apparently frustoconical form cooperating with an apparently frustoconical valve seat within the outlet of the housing. The upper end of the stem is externally screwthreaded to receive an internally screwthreaded metal disc formed with angularly drilled apertures each inclined inwardly and downwardly and having its lower end spaced from the stem. These apertures permit fuel to pass to beneath the disc. The valve stem is maintained in position on the disc by a lock nut. The central bore of the valve housing is counterbored to receive a distance piece and a helical spring bearing at its lower end on the distance piece and at its upper end against the underside of the disc. In the bottom of the chamber and underneath the disc is a ring of elastomeric material which is normally separated from the underside of the disc by a small free space. When the nozzle is operated at low delivery rates, fuel enters the chamber and passes through the apertures in the disc and down to the valve seat. The fuel pressure thereby built up downstream of the disc ultimately forces the valve closure member to open against the force of the spring, so that the fuel is injected, but a small free space still remains between the elastomeric ring and the disc. However, at high delivery rates, the valve opens more, thus pressing the disc against the ring and thereby closing the free space. Thereupon, less of the underside of the disc is exposed to the fuel pressure, so that the valve is maintained more reliably in that position.

With the fuel injection nozzle just described, dirt and bacteria can accumulate in places where cleaning fluid passed through the nozzle would not wash them away, for example, in the screwthreading between the disc and the stem.

SUMMARY OF THE INVENTION

According to a first aspect of the present invention, there is provided a liquid-dispensing nozzle, comprising a tubular housing, an annular valve seat on said housing and substantially co-axial therewith and bounding an internal surface of said housing, a valve member including a valve closure part and extending substantially co-axially in said housing and movable relative to said housing axially thereof between a closed condition in which said valve closure part acts sealingly against said valve seat and an open condition in which said valve closure part is spaced from said valve seat, and said valve member also including a valve driving part upstream of said closure part and substantially obturating said tubular housing and arranged to be displaced by a pressure differential between a higher pressure upstream of said driving part and a lower pressure downstream thereof thereby to open said closure part, and a linking part interconnecting said driving part and said closure part and comprising a stem closely encircled by said driving part, biassing means urging said valve member towards said closed condition, and aperture means enabling liquid to flow from upstream of said driving part to downstream thereof, characterized in that said aperture means comprises an annular gap between said stem and said driving part, whereby liquid flows to the downstream portion of the zone of connection between said driving part and said linking part.

This aspect of the invention has the advantage that the area over which the pressure differential acts is relatively large, so that a relatively lower pressure differential can open the valve member, so that the rate and thus the turbulence of liquid flow into a container being filled can be relatively lower, and so that the opening force on the valve member can be more than sufficient to avoid hunting of the valve member and thus can improve the steadiness of flow of the liquid into the carton.

In this manner, the junction between the driving part and the stem, which is a likely location for foreign matter to gather, can readily be kept clean by cleaning fluid passed through the nozzle, thereby reducing the risk of contamination of the liquid.

According to a second aspect of the present invention, there is provided a liquid-dispensing nozzle, comprising a tubular housing, an annular valve seat on said housing and substantially co-axial therewith, and a valve member including a valve closure part and extending substantially co-axially in said housing and movable relative to said housing axially thereof between a closed condition in which said closure part acts sealingly against said valve seat round an annulus of sealing co-axial with said housing and defined by said valve seat and an annular surface zone of said closure part and an open condition in which said closure part is spaced from said valve seat and substantially a tube of liquid exits from between said housing and said closure part, said valve member also including fins in sliding contact with the internal surface of said housing, at least one of said fins being sufficiently wide at its downstream axial end zone to ensure that, downstream of said valve member, there is a vent in said tube of liquid, characterized in that one of said fins extends upstream from immediately adjacent to an inner periphery of said annular surface zone of said closure part.

This arrangement to ensure that, in spite of the tendency of the liquid just past the fins to re-unite around that annular surface portion of the closure part which co-operates with the seat to form the annulus of sealing, there is a vent in the tube of liquid, prevents the accumulation of air under significant pressure within the tube and thus prevents significant disruption of the flow of liquid into a container, and so minimises splashing of the liquid beyond the container.

According to a third aspect of the present invention, there is provided apparatus comprising feeding means arranged to feed a fluid, said feeding means comprising ducting, a reciprocatory bellows communicating with said ducting, a driving member connected to said bellows for reciprocating said bellows, an outlet valve in said ducting arranged to open to allow the fluid to flow from the bellows during a pressure stroke thereof, and an inlet valve arranged to open to allow the fluid to flow to the bellows during the suction stroke thereof, characterized in that a second bellows is connected upstream of said inlet valve, and said driving member is connected to a section of said ducting between the bellows and carrying said inlet valve for reciprocating said section and said inlet valve and thus both of the bellows.

The provision of the second bellows upstream of the inlet valve and the driving of the section of the ducting between the two bellows has the advantage of giving a relatively simple feeding system with the added advantage of allowing a relatively high rate of reciprocatory movement.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENT

Figure 1:
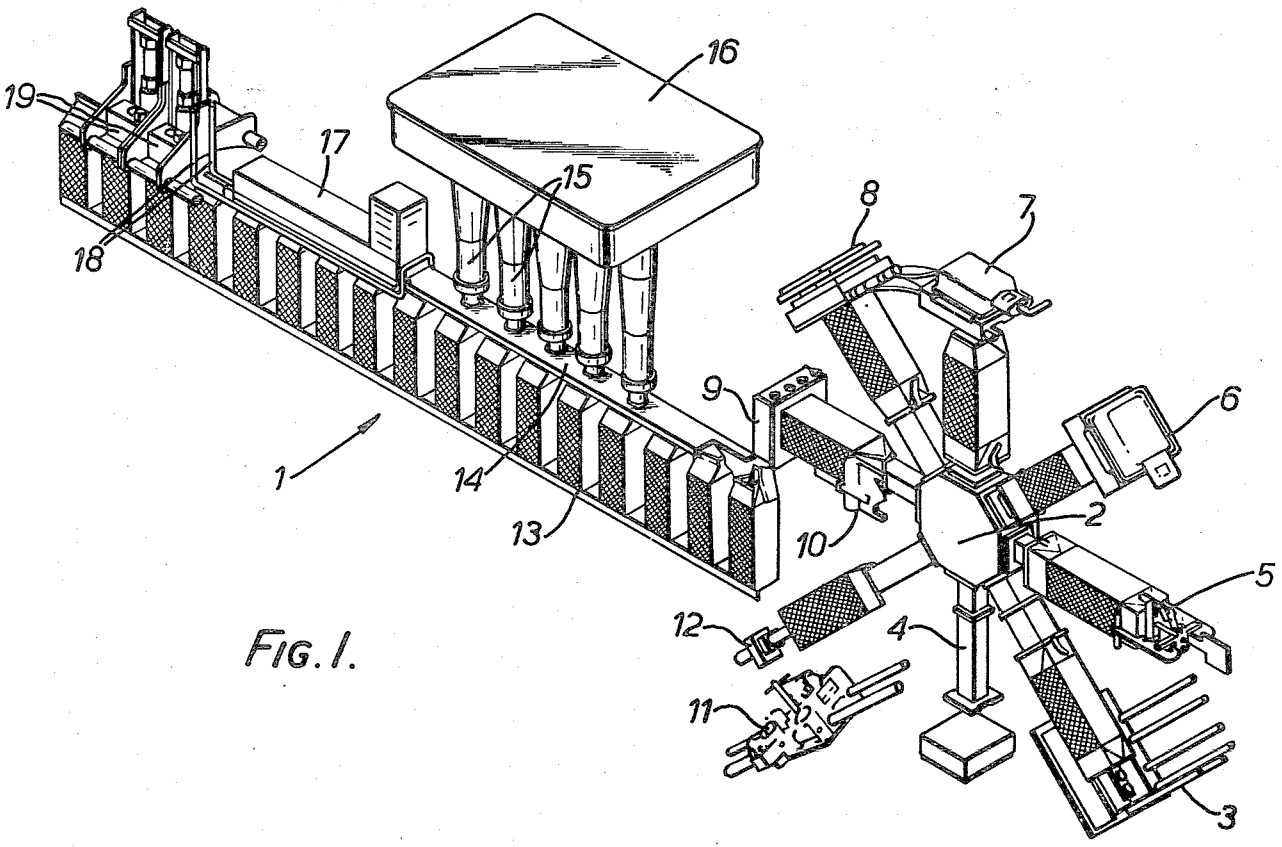
FIG. 1 shows a diagrammatic perspective view of a packaging machine.

Referring to the drawings, the machine 1 for carrying out packaging includes at one end of the machine a conventional device 2 for pre-forming (including bottom-sealing) gable-topped cartons. The open-topped per-formed cartons are taken to the other end of the machine by means of a chain system (not shown), which advances the open-topped cartons step-wise and in a vertically upright condition.

Vacuum cups on a carton picker (not shown) pull a single carton blank, consisting of paperboard coated on both faces with thermoplastics, from a carton basket 3, open it and place it in position in loading guides. A hydraulically operated loader chain pushes the open carton blank onto a forming mandrel 4 which then indexes to the next position.

A bottom breaker 5 closes up on the carton bottom and folds it on pre-scored lines.

At the next two index positions, the carton is placed under bottom heaters 6 and 7, which heat the plastics in preparation for bottom sealing.

As the mandrel indexes to the next station, the carton passes through top folding rails and stops in position under a bottom press 8. The bottom press advances and cools and seals the carton bottom.

At the next index position, a bottom press 9 advances and cools and seals the carton bottom again, and top breakers 10 break the carton top on pre-scored fold lines.

At the next station, the carton is pulled off the mandrel by an unloader 11 and is placed on an unloader vacuum cup on a transfer tube 12.

The transfer tube then tilts the carton through 45° into a filler section 13, at which time a carton lock swings down and holds the carton in place.

The carton is indexed through the section 13 by the chain system.

A spreader plate 14 engages the carton top and guides the carton into position under a row of five dosaging filling devices 15 connected to a supply tank 16 containing milk, for example. The carton is indexed through five stages of filling at the five devices, and receives approximately one-fifth fill at each station, if all the devices 15 are in use.

At the next station, the filled carton top is heated under an electric top heater 17. The carton then passes through cooled top folding rails 18 and is sealed by sealer jaws 19. The filled and sealed carton is then indexed out onto an accumulating table.

The machine as so far described is of a conventional type.

Figure 2:
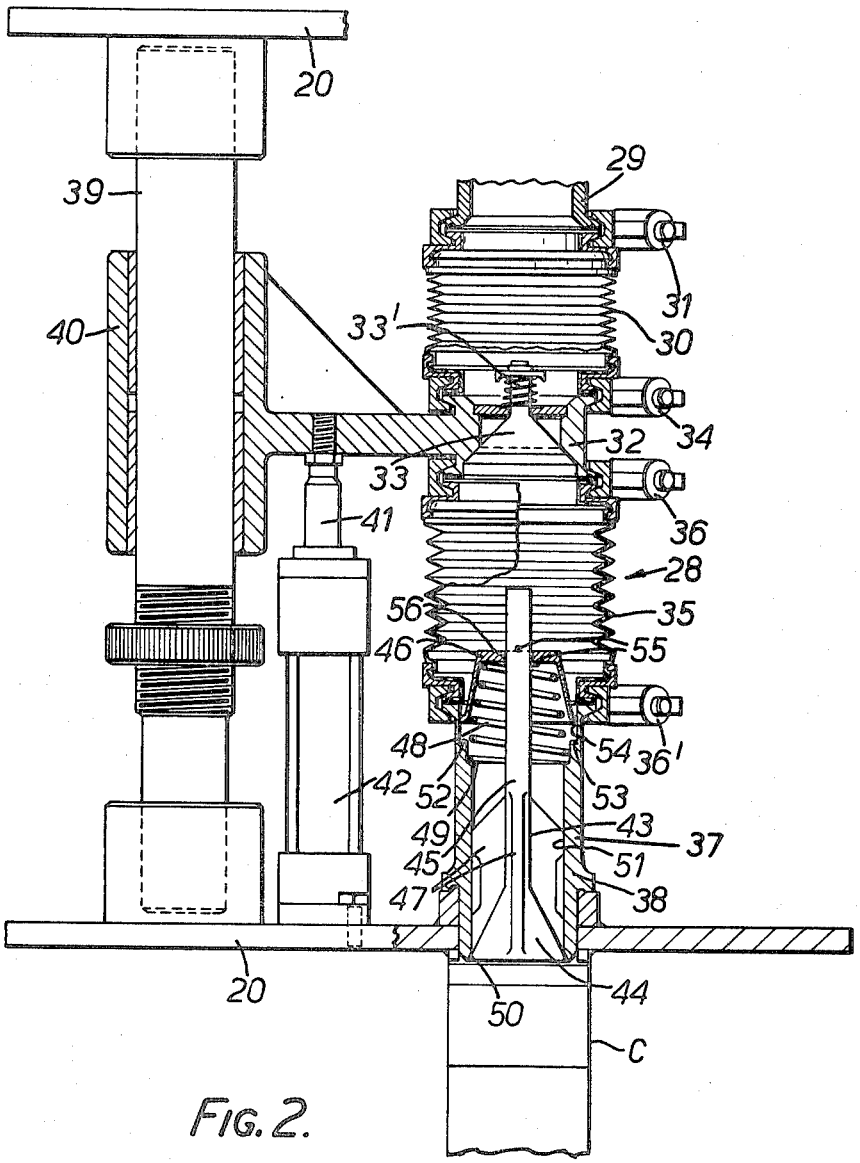
FIG. 2 shows a sectional end elevation of the machine.

As shown in FIG. 2, each filling device 15 includes a mounting frame 20 which mounts a row of five vertical ducts 28 each consisting of an uppermost ducting section 29 connected to the supply tank 16, an upper bellows 30 attached at its upper end to the section 29 by a clamp 31, a lower ducting section 32 containing a non-return inlet valve 33 and attached at its upper end by means of a clamp 34 to the bellows 30, a lower bellows 35 connected at its upper end by means of a clamp 36 to the section 32, and a nozzle 37 connected at its upper end by means of a clamp 36' to the bellows 35. The bellows 30 and 35 are of polypropylene and have been formed by blow-moulding. The nozzle 37 includes a vertical tubular housing 38 fixed in the mounting frame 20. The mounting frame 20 includes five vertical pillars (of which one is seen in FIG. 2 and referenced 39). Vertically slidably mounted on each pillar is a bracket 40 integral with the ducting section 32 and connected to a piston rod 41 of an hydraulic or pneumatic ram 42 which acts between the frame 20 and the bracket 40 and of which the cylinder is fixed to the frame 20. There is thus one ram for each vertical duct 28. Arranged co-axially in each housing 38 is a valve member 43 which consists of a frusto-conical closure part 44, a vertical central stem 45 extending upwardly from the part 44, a driving part 46 of inverted cup shape attached to the upper end of the stem 45, and four vertical fins 47 extending upwardly from the part 44 and arranged to slide on the internal surface of the housing 38 in order to guide movement of the valve member 43 in the housing 38. A spiral compression spring 48 acting between an internal, upwardly facing shoulder 49 of the housing 38 and the base of the inverted cupshaped part 46 urges the valve member 43 into the closed condition shown in FIG. 2, in which the outer peripheral edge zone of the frusto-conical part 44 bears face-to-face directly against a corresponding frusto-conical valve seat 50 formed at the lower extremity of the internal surface of the housing 38. The fins 47 terminate as closely as practical to the outer peripheral end zone of the part 44, while leaving an adequate seating. From the valve seat 50, the internal surface of the housing 38 continues upwards as a circular cylindrical bore surface 51 and thence as the upwardly facing surface of the shoulder 49. A short distance above the shoulder 49 is another upwardly-facing shoulder 52. Arranged on the shoulder 52 are upstanding lugs 53 integral with the housing, which serve as abutments which cooperate with the outer peripheral edge zone of the part 46 to provide a positive limit to the maximum extent of opening of the valve member 43 and thus define the fully open position of the member 43. Between the outer peripheral edge zone of the part 46 and the internal surface of the housing 38 is a very narrow annular gap or clearance 54 through which liquid can flow. The part 46 is attached to the stem 45 by means of pins 55 fixed in radial holes in the stem 45. There is a very narrow annular gap or clearance 56 through which liquid can flow between the part 46 and the stem 45. The gap 54 is of a width in the range between 15 thousandths and 40 thousandths of an inch and of a diameter of at least one inch. For example it can be of a width of 20 thou. and a diameter of 3 inches. The gap 56 is about 20 thou. wide and about one half-inch in diameter. In addition to the gaps 54 and 56, the part 46 may be formed with perforations through which the liquid can flow. For the same rate of flow of liquid, the greater the external diameter of the driving part 46, the greater can be the width of the gap 54, because the pressure differential driving the part 46 can be smaller. The spring 48 needs to be strong enough to resist the head of liquid.

In the following description of the operation of the filling device, it will be assumed that in the initial condition of the device the valve member 43 is in the closed condition shown, and that both of the bellows 30 and 35 are full of liquid to be fed to the nozzle 37 and thence to a carton C below the nozzle.

The ram 42 displaces the bracket 40 upwards from the position shown. The pressure of the liquid in the bellows 30 on the inlet valve 33 opens the valve against the action of its closing spring 33' and the liquid flows into the bellows 35 as the ducting section 32 moves upwards and compresses the bellows 30. Upon the ram 42 reaching its upper end position and beginning to return downwards, the valve 33 closes automatically and the liquid in the bellows 35 is pressed by the ram 42 against the driving part 46. Although some of the liquid can pass through the gaps 54 and 56, the rate of flow therethrough is not enough to prevent a significant increase of pressure on the part 46 so that the member 42 moves downwards against the action of the spring 48 until the part 46 abuts against the lugs 53, which limit any further downward movement of the member 43. The closure part 44 is thus opened to its maximum extent. Under the pressure of the ram 42, the liquid in the bellows 35 continues to flow through the gaps 54 and 56. The liquid flow through the gap 54 is deflected inwardly by the shoulder 52, the liquid passing among the lugs 53. Thus the shoulder 52 changes the velocity of the liquid flow from the gap 54 to one the predominant component of which is axial of the housing 38 to one the predominant component of which is inwardly radial of the housing 38. The liquid flow deflected from the shoulder 52 thus interferes with itself and also intercepts and interferes with the predominantly axial liquid flow from the gap 56. The thereby combined flow proceeds down the housing 38 and flows in substantially separate streams among the fins 47. Each of the fins 47 is made of such width, at least at its lower end, that the streams of liquid do not re-combine immediately on leaving the fins 47, but instead leave between them vents downstream of the outer peripheral edge zone of the part 44, through which vents air can flow from the inside to the outside of the virtual tube of liquid formed. Each fin is approximately one half-inch wide at its lower end, reducing in width to about three-sixteenths inch over most of its height.

It will be noted that the cross-sectional area enclosed by the outer periphery of the annulus of sealing between the part 44 and the seat 50 is less than the effective surface area of the valve member 43 exposed to liquid pressure in the bellows 35. It will also be noted that the part 44 bears directly on the valve seat 50 and that neither the valve member 43 nor the housing 38 comprises nor carries any sealing ring effective between the valve member 43 and the housing 38. It will further be noted that, although all of the internal surface of the housing 38 is contacted, i.e. wetted, by the liquid passing through the housing, the housing does not have any internal surface portions beyond the valve seat 50, so that there are substantially no wetted portions of the housing 38 situated downwardly beyond the annulus of sealing between the valve seat 50 and the closure part 44. The flow of liquid through the gap 56 helps to clear away from the junction between the parts 45 and 46 any foreign matter which would otherwise gather there.

We claim:

1. Apparatus comprising feeding means arranged to feed a fluid, said feeding means comprising ducting, a reciprocatory bellows communicating with said ducting, a driving member connected to said bellows for reciprocating said bellows, an outlet valve in said ducting arranged to open to allow the fluid to flow from the bellows during a pressure stroke thereof, and an inlet valve arranged to open to allow the fluid to flow to the bellows during the suction stroke thereof, characterized in that a second bellows is connected upstream of said inlet valve, and said driving member is connected to a section of said ducting between the bellows and carrying said inlet valve for reciprocating said section and said inlet valve and thus both of the bellows.

2. A liquid-dispensing nozzle, comprising a tubular housing, an annular valve seat on said housing and substantially coaxial therewith and bounding an internal surface of said housing, a valve member including a valve closure part and extending substantially coaxially in said housing and movable relative to said housing axially thereof between a closed condition in which said closure part acts sealingly against said valve seat and an open condition in which said closure part is spaced from said valve seat, and said valve member also including a valve driving part upstream of said closure part and substantially obturating said tubular housing and arranged to be displaced by a pressure differential between a higher pressure upstream of said driving part and a lower pressure downstream thereof to open said closure part, and a linking part interconnecting said driving part and said closure part and comprising a stem closely encircled by said driving part, biassing means urging said valve member towards said closed condition, and aperture means enabling liquid to flow from upstream of said driving part to downstream thereof, characterized in that said aperture means comprises an annular gap between said stem and said driving part, whereby liquid flows to the downstream portion of the zone of connection between said driving part and said linking part.

3. A nozzle according to claim 2, wherein said driving part is of the shape of a cup opening in a downstream sense.

4. A liquid-dispensing nozzle, comprising a tubular housing, an annular valve seat on said housing and substantially coaxial therewith, and a valve member including a valve closure part and extending substantially coaxially in said housing and movable relative to said housing axially thereof between a closed condition in which said closure part acts sealingly against said valve seat round an annulus of sealing coaxial with said housing and defined by said valve seat and an annular surface zone of said closure part and an open condition in which said closure part is spaced from said valve seat and substantially a tube of liquid exits from between said housing and said closure part, said valve member also including fins in sliding contact with the internal surface of said housing, at least one of said fins being sufficiently wide at its downstream axial end zone to ensure that, downstream of said valve member, there is a vent in said tube of liquid, characterized in that said one of said fins extends upstream from immediately adjacent to an inner periphery of said annular surface zone of said closure part.

5. A nozzle according to claim 4, characterized in that all of said fins extend upstream from immediately adjacent to said inner periphery.

* * * * *

UNITED STATES PATENT AND TRADEMARK OFFICE

CERTIFICATE OF CORRECTION

PATENT NO. : 4,402,461

DATED : September 6, 1983

INVENTOR(S) : Richard W. E. Mosse and Kaare B.Vatne

It is certified that error appears in the above-identified patent and that said Letters Patent is hereby corrected as shown below:

Column 3, line 57, after "operational" correct "reliabiity" to --reliability--.

Column 6, line line 24, before "cartons" cancel "per-formed" and substitute therefor --pre-formed--.

Signed and Sealed this

*Thirtieth* Day of *July 1985*

[SEAL]

*Attest:*

DONALD J. QUIGG

*Attesting Officer* *Acting Commissioner of Patents and Trademarks*